United States Patent [19]

Fisher

[11] 4,445,769

[45] May 1, 1984

[54] APPARATUS FOR PROCESSING FILM DISCS

[76] Inventor: Oscar Fisher, Box 949 Ohayo, Mountain Rd., Woodstock, N.Y. 12498

[21] Appl. No.: 430,787

[22] Filed: Sep. 30, 1982

[51] Int. Cl.[3] ..... G03D 3/04; G03D 3/08

[52] U.S. Cl. ..... 354/322; 354/330; 134/79

[58] Field of Search ..... 354/316, 320, 322, 329, 354/330; 134/76, 78, 79, 80, 82, 137

[56] References Cited

U.S. PATENT DOCUMENTS

| | | | |
|---|---|---|---|
| 2,837,988 | 6/1958 | Pavelle | 134/82 |
| 4,112,452 | 9/1978 | Patton | 354/322 |
| 4,112,453 | 9/1978 | Hutchison | 354/322 |
| 4,112,454 | 9/1978 | Harvey | 354/330 |
| 4,153,363 | 5/1979 | Albano | 354/322 |
| 4,167,320 | 9/1979 | Hutchison | 354/330 |
| 4,178,091 | 12/1979 | Solomon | 354/323 |
| 4,188,106 | 2/1980 | Harvey | 354/330 |
| 4,203,664 | 5/1980 | Clifton et al. | 355/64 |
| 4,204,733 | 5/1980 | Modney et al. | 355/64 |
| 4,252,430 | 2/1981 | Michael | 134/79 |
| 4,257,695 | 3/1981 | Langworthy | 352/147 |

FOREIGN PATENT DOCUMENTS

| | | | |
|---|---|---|---|
| 632043 | 11/1949 | United Kingdom | 354/320 |

*Primary Examiner*—A. A. Mathews

*Attorney, Agent, or Firm*—Bucknam and Archer

[57] ABSTRACT

Apparatus for processing film discs carried upon a rod engaged by a shift means whereby the discs are carried stepwise along a path aligned with a series of trays each containing a solution used in the processing. The film discs are wetted about their entire periphery when positioned in the trays by the action of spinner means that rotatably drive the rod.

2 Claims, 8 Drawing Figures

APPARATUS FOR PROCESSING FILM DISCS

FIELD OF THE INVENTION

The present invention relates to apparatus for processing photographic film, and in particular to such apparatus in which a plurality of discrete, disc-shaped film elements, are stacked upon a rod that is carried along a path aligned with a plurality of trays, each containing a solution used in the processing.

DESCRIPTION OF THE PRIOR ART

A variety of apparatus have been heretofore devised for processing photographic film, and including processing of disc type film.

Typical prior art processing apparatus are exemplified by U.S. Pat. Nos. 4,112,452 to Patton; 4,112,453 to Hutchison; 4,112,454 to Harvey; 4,167,320 to Hutchinson; 4,178,091 to Solomon; 4,188,106 to Harvey; 4,203,664 to Clifton et al; 4,204,733 to Modney et al; 4,248,564 to Gentile et al; 4,252,430 to Michal; and 4,257,695 to Langworthy.

In this prior art, it is generally known to process film discs on a rod that is carried through the equipment and wherein the film discs are subjected to contact with various solutions as required for their proper development.

However, the typical prior art developing apparatus is rather complex, and in certain cases presents a certain production limitation that is avoided by the apparatus of the subject invention.

SUMMARY OF THE INVENTION

The invention provides an apparatus for processing film discs carried in a stacked array on a rod. Basically, the apparatus comprises a base means which supports a plurality of trays each containing a solution used in the processing; a shift means; and spinner means. The trays are aligned along a given path extending from an input end to an output end. The shift means is operable to engage the rod and to carry it with the film discs thereon stepwise along this path. This action of the shift means correspondingly positions the film discs in the sequence of solution-containing trays for processing thereby. The spinner means is utilized to rotatably drive the rod and impart thereto a spinning motion whereby the film discs are wetted about their entire periphery when positioned in the trays.

The apparatus, while describable in terms of a single rod of film discs, is operable simultaneously with a plurality of such rods with film discs, each rod and its associated film discs being at a separate, distinctive position along the processing path, at any given time.

In contrast to the prior art, the sequential movement of the rods and film discs is effected in the invention by the shift means, which extends lengthwise along the travel path, and is designed to engage the plurality of rods to move them in unison along the path in spaced-apart relation therealong. The shift means is moveable cyclically and carries the rods (and film discs thereon) stepwise in a forward direction about the movement cycles, and returns to a reference position in a backward direction about such path without the rods. Accordingly, the rods are progressively advanced to effect sequential processing of the film discs that they carry, by the solutions contained in the trays.

Further provided in accordance with the invention are means to automatically replenish the solutions in the trays in accordance with the number of film discs processed. Monitoring of the quantity of film discs passing each tray is achieved by sensors to control the action of feeder devices through which new solutions are fed into the trays.

BRIEF DESCRIPTION OF THE DRAWINGS

The invention is hereinafter described in connection with the attached drawings which form a part hereof and in which.

DETAILED DESCRIPTION OF THE PREFERRED EMBODIMENTS

Figure 1:
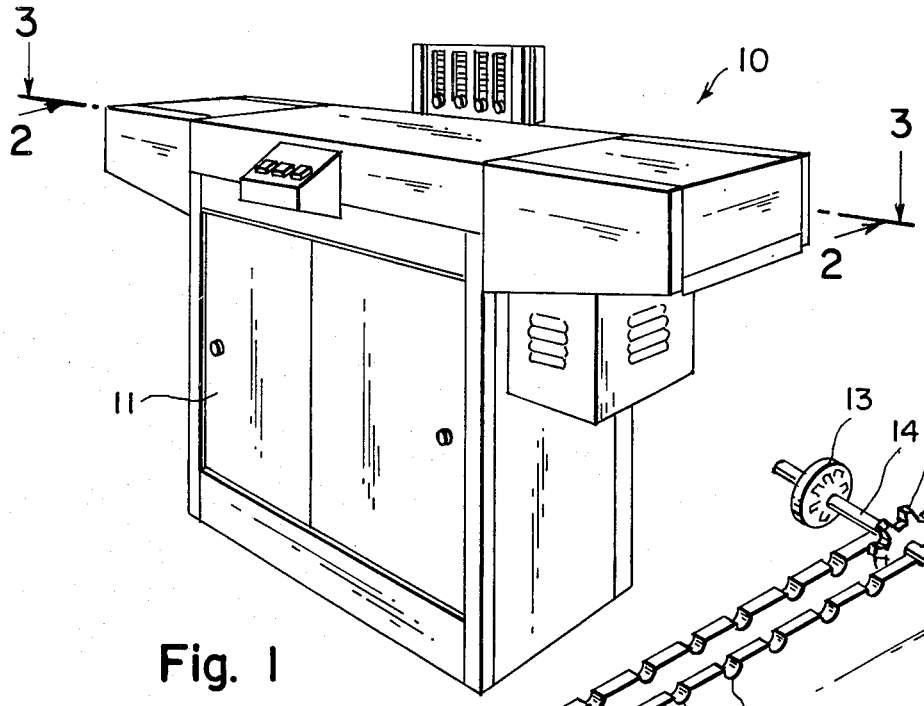
FIG. 1 is a schematic perspective view of an apparatus for processing film discs according to a preferred embodiment of the invention.
Figure 2:
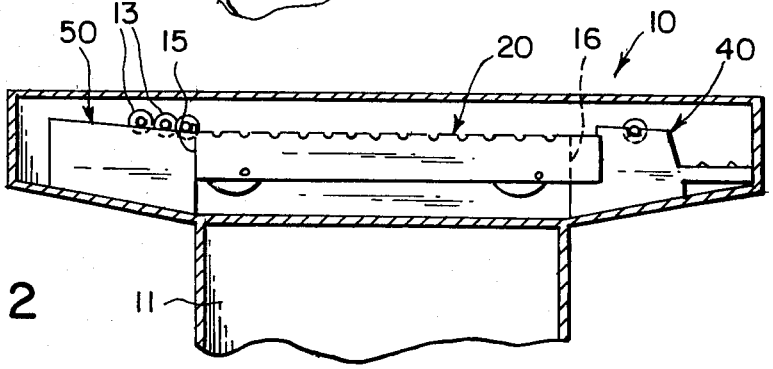
FIG. 2 is a schematic elevation view, partly in section, of the apparatus shown in FIG. 1, as taken along line 2—2 therein.
Figure 3:
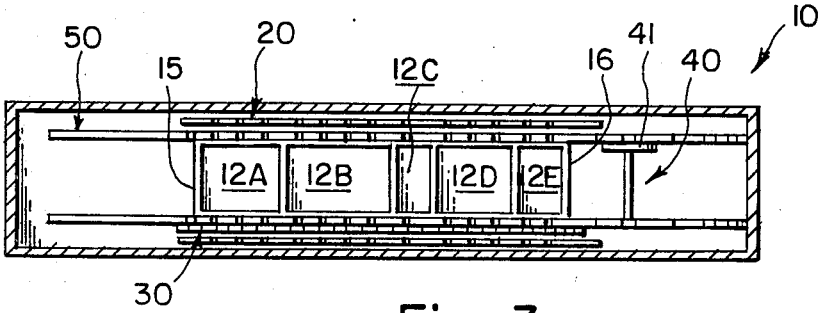
FIG. 3 is a schematic plan view, partly in section, of the apparatus shown in FIG. 1, as taken along line 3—3 therein.

As shown in FIGS. 1–3, the apparatus 10 in accordance with one embodiment of the invention comprises a base 11 which supports a plurality of trays 12A–12E each containing a solution used in processing the film discs 13 that are carried in a stacked array on a rod 14.

Trays 12A–12E are aligned along a generally straight path extending from an input end 15 to an output end 16. The provision of five trays 12A–12E is purely by way of example and in any particular case, the actual number could vary. Likewise, the number of solutions used could vary in any particular case. The term solution as used herein is broadly intended to designate any liquid bath through which the film discs are passed for treatment, regardless of whether such bath is a true solution, a suspension, or even pure water or other solvent.

To carry the film discs 13 stepwise along the path leading through the trays 12A–12E, the invention provides a mechanism that might broadly be designated as a shift means 20. In general, the shift means 20 is operable to engage each rod 14 and carry it with film discs 13 thereon stepwise along the path through trays 12A–12E to correspondingly position in sequence the film discs 13 in such solution-containing trays 12A–12E for processing thereby.

Because the film discs 13 have exposed picture areas located peripherally around each disc 13, it is necessary that each picture area be thoroughly wetted with each solution involved in the processing. This wetting of each complete film disc 13 picture area is achieved by what might be broadly designated as a spinner means 30. In general, the spinner means 30 is disposed to rotatably drive each rod 14 and impart thereto a spinning motion whereby the film discs 13 carried are wetted about their entire periphery when positioned in the tray 12A–12E.

After the film discs 13 are processed in the last tray 12E, they are transferred to a dryer stage 40 of the apparatus where they are rotated at a somewhat higher speed than when immersed in the trays 12A–12E, to spin off whatever solution remains on the discs 13 from the last tray 12E. Accordingly, the dryer 40 is located in adjoining relation to the output end 16 of the tray alignment path and includes a rotary drive mean 41 that is operable to rotate the rod 14 with film discs 13 presented, to aid in the drying of the film discs 13.

Dryer 40 is so designed and arranged as to handle a single rod 14 of film discs 13 at a time. This is merely to simplify the overall apparatus, and has been found to be suitable.

In more detail, the apparatus 10 includes a receiving means 50 disposed at the input end 15, and which is operable to receive a plurality of rods 14 each with a quantity of film discs 13 thereon, and which delivers each rod 14 with discs 13 into the shift means 20, in sequence.

Figure 4:
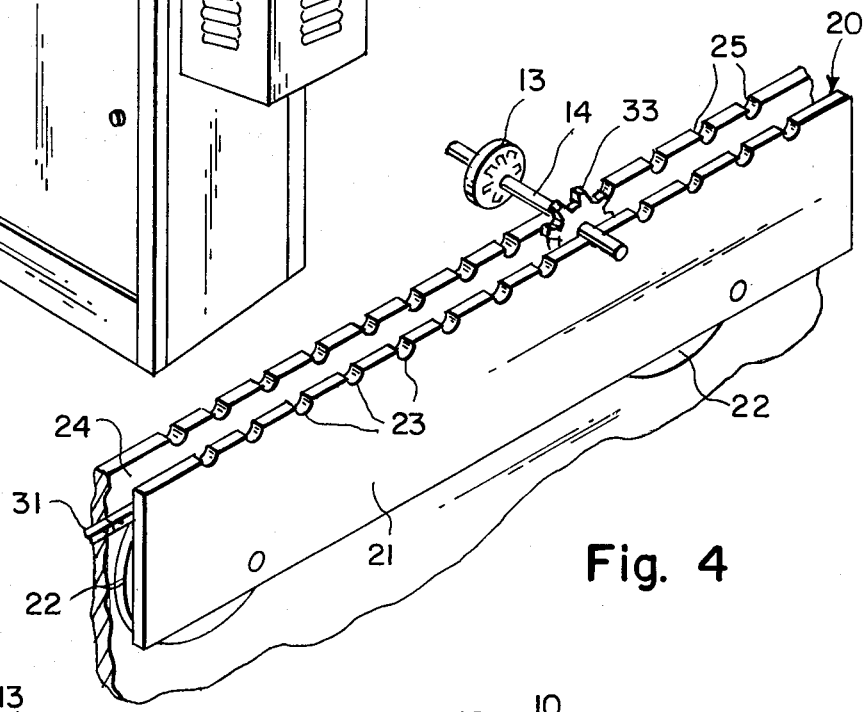
FIG. 4 is a schematic perspective view illustrating the shift means employed in the apparatus to move the rods and film discs thereon stepwise through the processing solutions.
Figure 6:
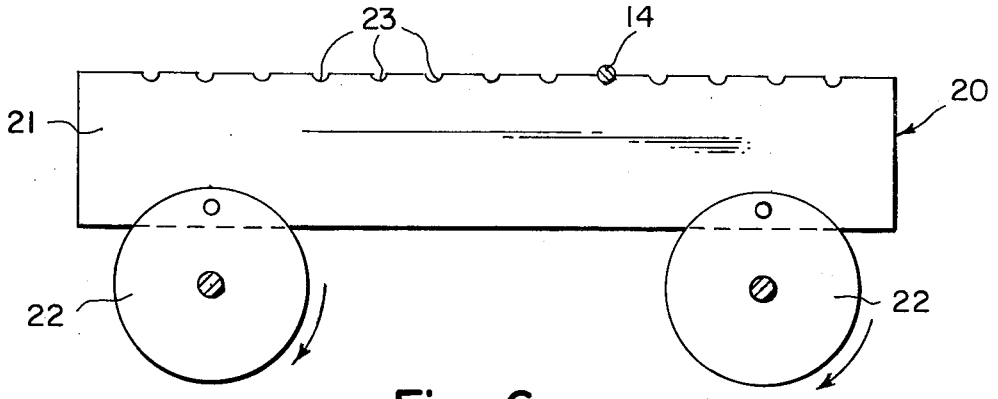
FIG. 6 is a schematic side elevation view, partly in section, illustrating preferred drive mechanism for the shift means for the apparatus.

FIGS. 4 and 6 illustrate the shift means 20 and its drive mechanism. A pair of spaced parallel bars 21, one on each side of the row of trays 12A–12E, are eccentrically connected to respective pairs of wheels 22, at least one of which is driven by a motor (not shown). Both of the bars 21, are driven in unison as the wheels 22, rotate about their respective axes.

On bars 21 are notches 23 that are uniformly spaced and which are essentially aligned as between corresponding notches 23 on each bar 21. Alignment of the notches 23 is provided so that the rods 14 can be received in respective pairs of notches 23. Bars 21 are moveable and cooperate with another pair of bars 24 that are similar as to having notches 25, but are different because bars 24 are fixed in position. Movable bars 21 serve to transfer, or shift the rods 14 along the path of the trays 12A–12E, whereas the fixed bars 24 serve to hold the rods 14 at various corresponding positions along such path, at least temporarily. Bars 21 are moveable cyclically, about paths defined by their connection to wheels 22, which movement carries the rods 14 stepwise in a forward direction about said path during one portion of the movement cycle in which bars 21 are raised above the fixed bars 24. As bars 21 swing downward with respect to fixed bars 24, as when the bars 21 return below bars 24 to their reference starting position, the rods 14 which had been previously carried forward, are left in respective notches 25 of the fixed bars 24. Thus, each complete, round-about cycle of movement by bars 21 causes all of the rods 14 which they carry to advance forwardly by a step length that corresponds to the spacing of adjacent sets of notches 23, 25. The film discs 13 are in this way on rods 14 progressively advanced along the path for sequential processing by the solution contained in the trays 12A–12E.

Figure 5:
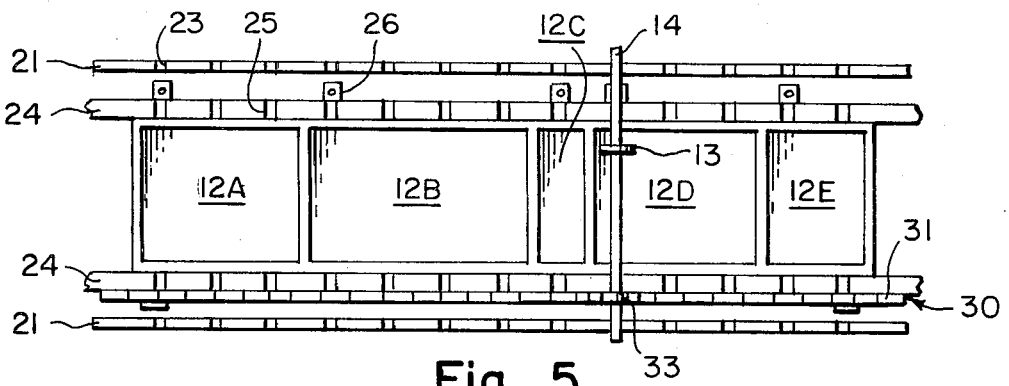
FIG. 5 is a schematic plan view illustrating a typical tray layout for holding the processing solutions, and the spinner means which rotatably drives the rods in relation to the shift means.

In FIG. 5, it can be noted that the trays 12A–12E are essentially in contiguously adjoining relation, and are of different lengths along the rod movement path. The length of each tray 12A–12E corresponds to the respective processing step times. For example, tray 12A extends for a length corresponding to three notches 23, 25 on bars 21, 24 whereas tray 12B extends for a length corresponding to four notches 23, 25. This means that the processing time in tray 12A is three units as compared to a four units processing time in tray 12B. The actual processing time is equal to the number of units multiplied by the time per unit, which is set by the shifting speed of the bars 21 and hence by the speed of their drive motor (not shown).

Replenishment of the solutions in trays 12A–12E is controlled by key switches 26 located along the leading notch 25 associated with the length of fixed bar 24 along each tray 12A–12E. Key switches 26 effect a count of the number of rods 14 full of discs 13 that have been processed by each tray 12A–12E, and depending upon the respective preset count for the individual tray 12A–12E, replenishment of the solution therein will be effected by means not shown.

Figure 7:
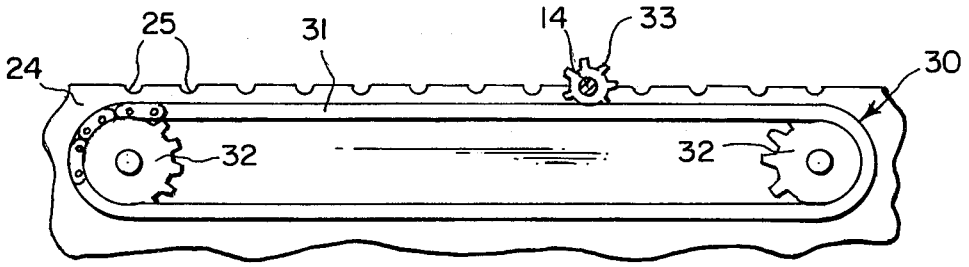
FIG. 7 is a schematic side elevation view, partly in section, illustrating a preferred drive mechanism for the spinner means for the apparatus.

In FIG. 7, the spinner means 30 is shown as having a continuous drive chain 31, supported and driven by gear wheels 32. Drive chain 31 is so positioned that its upper level engages a pinion 33 carried by each rod 14 in the processing area defined by the assembly of trays 12A–12E. Since each rod 14, when not actually undergoing a shifting movement, is held captive by corresponding notches 23, 25, the movement of chain 31 imparts a rotation to the rod 14 and hence a rotary motion to the film discs 13 carried thereby. When each rod 14 is raised upward by bars 21, its pinion 33 is withdrawn from engagement with drive chain 31, such that the discs 13 carried by such rod are not wetted by the solution in any underlying tray 12A–12E. Thus, chain 31 provides for rotating the discs 13 only when they are not lifted up out of the solutions in trays 12A–12E. This prevents contamination of solutions among successive trays 12A–12E as might occur if the rotation of discs 13 were not interrupted during their transfer along the trays 12A–12E.

Figure 8:
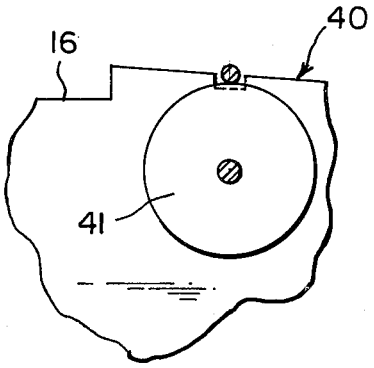
FIG. 8 is a schematic side elevation view, partly in section, illustrating a preferred driving arrangement for a dryer section of the apparatus.

FIG. 8 shows in detail the dryer stage 40 which adjoins the output end 16 of the processing trays 12A–12E section. In the dryer 40, there is provided rotary drive means 41 operable to rotate the rod 14 and film discs 13 thereon to drive off the liquid thereon and thereby aid in drying of such film discs.

What is claimed is:

1. An apparatus for processing film discs carried in stacked arrays on respective rods, which comprises a base means which supports a plurality of trays each containing a solution used in the processing, said trays being aligned along a given path extending from an input end to an output end; shift means operable to engage said rods and carry same with film discs thereon stepwise along said path, to correspondingly position in sequence the film discs in said solution-containing trays for processing thereby; and spinner means disposed to rotatably drive said rods and impart thereto a spinning motion whereby said film discs are wetted about their entire periphery when positioned in said trays; said shift means including at least one bar that extends lengthwise along said path and is disposed to engage a plurality of said rods to move same in unison along said path in spaced-apart relation therealong; said shift means bar being movable cyclically to carry said rods stepwise in a forward direction about said path during one portion of its movement cycle, and to return to a reference position in a backward direction about said path without said rods, to thereby progressively advance said rods and film discs along said path for sequential processing by the solutions contained in said trays, and wherein said trays are disposed in a row in adjoining relation along said path, and said trays have respective lengths along said path corresponding to the relative processing time for said film discs in the solutions contained in said trays.

2. An apparatus for processing film discs carried in stacked arrays on respective rods, which comprises a base means which supports a plurality of trays each containing a solution used in the processing, said trays being aligned along a given path extending from an input end to an output end; shift means operable to engage said rods and carry same with film discs thereon stepwise along said path, to correspondingly position in sequence the film discs in said solution-containing trays for processing thereby; and spinner means disposed to rotatably drive said rods and impart thereto a spinning motion whereby said film discs are wetted about their entire periphery when positioned in said trays; said shift means including at least one bar that extends lengthwise along said path and is disposed to engage a plurality of said rods to move same in unison along said path in spaced-apart relation therealong; said shift means bar being movable cyclically to carry said rods stepwise in a forward direction about said path during one portion of its movement cycle, and to return to a reference position in a backward direction about said path without said rods, to thereby progressively advance said rods and film discs along said path for sequential processing by the solutions contained in said trays, and wherein said trays are disposed in a row in adjoining relation along said path, and said trays have respective lengths along said path corresponding to the relative processing time for said film discs in the solutions contained in said trays, and further comprising a switch disposed in alignment with each of said trays, said switch being operable to count the number of rods carrying film discs that have been processed in such tray.

* * * * *